US008496784B2

(12) United States Patent
Ballinger

(10) Patent No.: US 8,496,784 B2
(45) Date of Patent: Jul. 30, 2013

(54) PROCESS FOR MAKING A STIFFENED PAPER

(75) Inventor: Thomas W. Ballinger, Thomasville, PA (US)

(73) Assignee: P.H. Glatfelter Company, York, PA (US)

( * ) Notice: Subject to any disclaimer, the term of this patent is extended or adjusted under 35 U.S.C. 154(b) by 0 days.

(21) Appl. No.: 13/080,217

(22) Filed: Apr. 5, 2011

(65) Prior Publication Data

US 2012/0255696 A1 Oct. 11, 2012

(51) Int. Cl.

| | |
|---|---|
| ***D21H 17/00*** | (2006.01) |
| ***D21H 17/28*** | (2006.01) |
| ***D21H 21/14*** | (2006.01) |
| ***D21H 23/02*** | (2006.01) |
| ***D21H 23/24*** | (2006.01) |
| ***D21H 23/50*** | (2006.01) |
| ***D21H 17/52*** | (2006.01) |

(52) U.S. Cl.

USPC ..... 162/158; 162/135; 162/175; 162/183; 162/184; 162/164.3; 162/177; 162/178

(58) Field of Classification Search

USPC ..... 162/9, 135–137, 157.6, 158, 175, 162/177–178, 183–185; 8/116.1, 181

See application file for complete search history.

(56) References Cited

U.S. PATENT DOCUMENTS

| | | | | |
|---|---|---|---|---|
| 1,998,758 | A * | 4/1935 | Holt et al. | 162/10 |
| 3,160,552 | A | 12/1964 | Russell | |
| 3,455,778 | A * | 7/1969 | Bernardin | 162/113 |
| 3,468,706 | A * | 9/1969 | Speakman | 127/33 |
| 3,535,202 | A * | 10/1970 | Huang | 162/160 |
| 3,597,313 | A | 8/1971 | Williams | |
| 3,630,831 | A * | 12/1971 | Jongetjes | 162/156 |
| 3,908,071 | A * | 9/1975 | Heim et al. | 428/323 |
| 4,124,439 | A * | 11/1978 | Dessauer | 162/146 |
| 4,146,669 | A | 3/1979 | Dikler | |
| 4,461,858 | A | 7/1984 | Adelman | |
| 4,537,807 | A | 8/1985 | Chan | |
| 4,748,076 | A * | 5/1988 | Saotome | 442/118 |
| 4,966,652 | A * | 10/1990 | Wasser | 162/135 |
| 5,137,537 | A * | 8/1992 | Herron et al. | 8/120 |
| 5,147,908 | A | 9/1992 | Floyd | |
| 5,281,307 | A | 1/1994 | Smigo | |
| 5,328,567 | A | 7/1994 | Kinsley, Jr. | |
| 5,362,573 | A * | 11/1994 | Pandian et al. | 428/511 |
| 5,824,190 | A * | 10/1998 | Guerro et al. | 162/135 |
| 5,840,787 | A | 11/1998 | West | |
| 5,853,540 | A | 12/1998 | Niemoller | |
| 5,906,894 | A * | 5/1999 | West et al. | 428/507 |
| 5,958,180 | A * | 9/1999 | Hubbe et al. | 162/9 |
| 6,034,181 | A * | 3/2000 | Bazaj et al. | 525/218 |
| 6,124,124 | A | 9/2000 | Brady | |
| 6,165,322 | A * | 12/2000 | Bower | 162/164.3 |
| 6,179,962 | B1 | 1/2001 | Brady | |
| 6,281,291 | B1 * | 8/2001 | Bazaj et al. | 525/218 |
| 6,379,499 | B1 | 4/2002 | Yang | |
| 6,409,881 | B1 * | 6/2002 | Jaschinski | 162/9 |
| 6,436,231 | B1 | 8/2002 | Graef | |
| 6,494,990 | B2 * | 12/2002 | Bazaj et al. | 162/168.3 |
| 6,620,293 | B2 * | 9/2003 | Sears et al. | 162/157.6 |
| 6,635,755 | B1 * | 10/2003 | Jaschinski et al. | 536/56 |
| 6,695,950 | B1 * | 2/2004 | Cimecioglu et al. | 162/157.6 |
| 6,736,933 | B2 | 5/2004 | Jewell | |
| 6,797,119 | B2 * | 9/2004 | Koike | 162/218 |
| 6,939,441 | B2 * | 9/2005 | Nurminen et al. | 162/135 |
| 7,018,511 | B2 * | 3/2006 | Sears et al. | 162/157.6 |
| 7,074,301 | B2 * | 7/2006 | Hamed et al. | 162/157.6 |
| 7,108,765 | B2 * | 9/2006 | Halabisky | 162/117 |
| 7,288,167 | B2 * | 10/2007 | Sears et al. | 162/72 |
| 7,404,875 | B2 | 7/2008 | Clungeon | |
| 7,488,403 | B2 | 2/2009 | Hagiopol | |
| 7,604,714 | B2 * | 10/2009 | Luo et al. | 162/158 |
| 2001/0051687 | A1 * | 12/2001 | Bazaj et al. | 525/218 |
| 2002/0031971 | A1 * | 3/2002 | Westland et al. | 442/415 |
| 2002/0060004 | A1 * | 5/2002 | Koike | 162/123 |
| 2002/0112296 | A1 * | 8/2002 | Graef et al. | 8/115.51 |
| 2003/0121632 | A1 * | 7/2003 | Nurminen et al. | 162/158 |
| 2003/0155087 | A1 * | 8/2003 | Sears et al. | 162/9 |
| 2003/0181115 | A1 * | 9/2003 | Nagasuna et al. | 442/149 |
| 2004/0065423 | A1 * | 4/2004 | Swerin et al. | 162/137 |
| 2004/0074616 | A1 * | 4/2004 | Sears et al. | 162/9 |
| 2005/0155731 | A1 | 7/2005 | Martin | |
| 2006/0118255 | A1 * | 6/2006 | Sears et al. | 162/9 |
| 2006/0275347 | A1 | 12/2006 | EversSmith | |
| 2007/0009464 | A1 | 1/2007 | Laine | |
| 2008/0233385 | A1 | 9/2008 | Ullmann | |
| 2008/0264590 | A1 | 10/2008 | Carroll | |
| 2009/0020247 | A1 * | 1/2009 | Swerin et al. | 162/124 |
| 2010/0166968 | A1 * | 7/2010 | Doherty et al. | 427/387 |

FOREIGN PATENT DOCUMENTS

| | | |
|---|---|---|
| GB | 1396891 | 6/1975 |
| GB | 1471226 | 4/1977 |
| GB | 2324615 | 10/1998 |
| WO | WO 9813545 A1 * | 4/1998 |
| WO | WO 9830387 A1 * | 7/1998 |
| WO | 2008036307 | 3/2008 |

* cited by examiner

*Primary Examiner* — Jose A Fortuna

(74) *Attorney, Agent, or Firm* — Stradley Ronon Stevens & Young, LLP

(57) ABSTRACT

A process for making a stiffened and rigid paper includes preparing a pulp slurry consisting essentially of water, a cellulosic pulp, a crosslinker, and a starch, and optionally a binder; draining the liquid from the pulp slurry to form a web; and drying the web. Alternatively, a process for making a stiffened and rigid paper includes the step of adding at least one crosslinker at one or more locations, such as at the wet-end, dry-end, or at both ends of the papermaking process. Suitable crosslinkers include a glyoxal-containing crosslinker, a gluteraldehyde, a polyfunctional aziridine, a zirconium-containing crosslinker, a titanium-containing crosslinker, and an epichlorohydrin, and mixtures thereof. When a binder is employed, it can be added either in the dry or wet form. Provided is a neutral or alkaline process to produce a paper product having the improved mechanical properties of a laminated product in the Z-direction, without a lamination step.

16 Claims, No Drawings

PROCESS FOR MAKING A STIFFENED PAPER

FIELD OF THE INVENTION

The present invention relates to a method for making a paper-based product which contains a crosslinker. The present invention also relates to manufactured paper products which exhibit increased stiffness and rigidity.

BACKGROUND OF THE INVENTION

The papermaking industry as well as other industries have long sought methods for enhancing the strength of products formed from fibrous materials such as, for example, paper and board products formed of cellulose fiber or pulp as a constituent. The dry-strength and related properties of a sheet formed from fibrous materials are especially important for various purposes. The problems and limitations presented by inadequate dry-strength have been particularly acute in the numerous industries where recycled furnish or fiber mechanically-derived from wood is utilized in whole or in part. In the papermaking industry for example, recycled cellulose fiber is typically used in the manufacture of newsprint and lightweight coated papers. These recycled fibers, however, are of a generally shorter length than chemically-pulped fibers. Paper produced from the shorter length recycled fibers have been found to have relatively poor dry-strength properties in comparison to paper manufactured from virgin, chemically-pulped fiber. The use of virgin chemically pulped fiber for all paper and board production, however, is extremely wasteful in terms of natural resource utilization and is cost-prohibitive in most instances and applications.

Various methods have been suggested in the past for improving the dry-strength and related properties of a sheet formed from fibrous materials such as paper or board materials formed of cellulose fiber. One method known in the art for improving the dry-strength properties of paper products, for example, involves the surface sizing of the sheet at a size press after its formation. While some of the critical properties of the product may be improved through sizing the surface of the sheets, not all equipment is amenable for such processes. Many papermaking machines, for example, including board and newsprint machines, are not equipped with a size press. Moreover, only the properties of the surface of the sheet are appreciably improved through surface sizing. Surface sizing, therefore, is either not available to a large segment of the industry or is inadequate for purposes of improving the strength of the product throughout the sheet. The latter factor is especially significant since paper failures during printing, for example, are obviously disruptive to production cycles and can be extremely costly.

A well-known method for increasing the strength of the paper product, without surface sizing of a sheet, is by lamination. Laminating is the process of applying a film to either one side or both sides of a pressed paper product. Lamination has been found to add stability to the sheet, allowing it to be more durable or stand upright. There are two major lamination categories: pouch and roll. Pouch lamination films are like envelopes and are sealed on one edge. Roll lamination films can involve a process in which a layer of film is applied to the front side of a document or it can involve a process in which the document is sandwiched between two layers and sealed by various lamination seal methods. The two most common methods of lamination are thermal lamination, which requires a heat source and pressure during the lamination process, and cold lamination, in which only one side of a document is laminated. The film used for cold lamination is much more costly than for thermal lamination, but the equipment is known to be less expensive. Additionally, cold lamination may not be as permanent as thermal lamination. Regardless of the lamination type or process utilized, lamination is known to be a costly method of adding strength to the paper product. It requires additional equipment, sealants, and films, and can introduce operational challenges to production time and quality control. Additionally, the lamination layer or layers contribute to the total finish caliper of the paper. Because total finish caliper of the paper is also an important consumer characteristic, processes which employ a lamination step are often restricted to using lower basis weight paper.

Another method to increase the strength of a paper product is through the addition of chemical additives directly to the fiber furnish prior to forming the sheet. One such process is taught by U.S. Pat. No. 5,328,567 to Kinsley, Jr. Common additives at the wet-end of a paper machine, for example, include cationic starch or melamine resins. The problem presented by these known wet-end additives used in the papermaking industry, however, is their inability to dramatically improve the mechanical properties of the paper in the Z-direction, such as peel strength, surface pick resistance and Scott internal bond. Another problem presented by such known wet-end additives is their relatively low degree of retention on the cellulose fiber during the initial formation of the sheet, at the wet-end of the paper machine. In most applications, significant portions of the wet-end additives accompany the white water fraction as it drains through the wire. This is due to high dilution and the extreme hydrodynamic forces created at the slice of a Fourdrinier machine. Alternatively, a significant portion of the additive may be lost in solution during the dwell time between its addition to the stock and the subsequent formation of the sheet on the machine. Accordingly, the use of known methods for internally strengthening fiber products have not produced a paper product with improved stiffness without the high costs and operational challenges associated with a lamination process.

Crosslinkers have been used in the paper-making industry. For example, U.S. Pat. No. 5,281,307 to Smigo et al. uses a crosslinking agent along with a polyvinyl alcohol/vinylamine copolymer containing between 0.5 and 25 mole % vinylamine units to improve certain properties of paper. In addition, GB Patent No. 1,471,226 relates to a process for the preparation of an aqueous dispersion of modified cellulose fibers, which comprises the steps of: (a) treating cellulose fibers, in aqueous dispersion, with a crosslinking agent capable, on the application of heat, of crosslinking cellulose fibers, (b) heating the dispersion to effect at least partial crosslinking of the cellulose fibers, and (c) treating the dispersion of at least partially crosslinked cellulose fibers with a polymer containing hydroxyl and/or amino groups. The desired paper product produced according to the '226 patent is to minimize jamming in a copying machine and therefore has a basis weight of preferably from 25 to 90 g/m^2 (i.e., 0.00512 lbs/ft^2 to 0.0184 lbs/ft^2).

U.S. Pat. No. 6,379,499 to Yang et al. discloses a method of treating paper comprising: contacting the paper with a hydroxy-containing polymer and a multifunctional aldehyde, in the presence of a catalyst in some embodiments. The multifunctional aldehyde may be gluteraldehyde, and the hydroxy-containing polymer may be polyvinyl alcohol. Yang teaches a process in which the multifunctional aldehyde and polyvinyl alcohol are pre-mixed (i.e., mixed together prior to their addition to the paper-making process). The multifunctional aldehyde of Yang is used to at least partially crosslink the polyvinyl alcohol, not the starch or pulp fibers, before the multifunctional aldehyde and the polyvinyl alcohol are added to the wet end pulp slurry. As Table 3 of Yang shows, the pre-mixing and crosslinking of gluteraldehyde and polyvinyl alcohol is necessary to retain or improve the dry strength and folding endurance of the resulting paper in the process according to Yang. With increased gluteraldehyde, however, the folding endurance is significantly decreased as a detriment to the desires of Yang. High amounts of multifunctional aldehydes have generally be found to exhibit a loss of dry strength and decreased folding endurance, which is in accordance with the findings of Yang, but has now been employed to produce a rigid sheet while retaining or improving stiffness.

While research into improving the mechanical properties of the paper in the Z-direction, surface pick resistance, and Scott internal bond remains on-going, there has recently been the emergence of alkaline papermaking processes to solve other unmet operational needs. Recent technologies employ a neutral or alkaline papermaking process, which is carried out at pH 6 to 10, instead of an acidic papermaking process. The neutral or alkaline papermaking process has many advantages over known acidic processes, such as, for example: (1) smaller energy utilization; (2) reduced corrosion of machinery; and (3) environmental benefits associated with the non-acidic white water system and waste stream.

In the conversion from acid papermaking to alkaline papermaking, customers often complained that the resulting paper product lost stiffness. Tests have shown that this loss was in the rigidness of the paper sheet, not in the actual stiffness measurements of the products. This is often described as a loss of snap or rattle in the paper product. As is known in the art, "rigidness" relates to the brittleness of a paper product (i.e., flexural stiffness or flexural rigidity), while "stiffness" relates to the bending resistance of the paper product. A loss in rigidness is an increase in the paper product's flexibility, but a loss in stiffness is a decrease in the amount that the paper product resists bending. To achieve a low thickness (e.g., low caliper) paper product with the necessary stiffness and rigidity, paper producers have had to thus far laminate sheets of lesser caliper together. However, this adds a substantial and costly step to the paper-making process and can not be utilized for all paper products as lamination increases the overall basis weight of the paper product.

SUMMARY OF THE INVENTION

It is highly desirable to utilize a papermaking process to produce a paper product having the improved mechanical properties of a laminated product in the Z-direction, such as peel strength, surface pick resistance, and Scott internal bond, without a lamination process. It is additionally desirable to utilize a neutral or alkaline papermaking process to produce a paper product with increased stiffness and rigidity, with higher basis weight, to match existing laminated products without the added step and cost of lamination. The non-laminated rigid sheet may additionally possess increased dimensional stability, if such characteristic is desired in the final paper product.

In one embodiment, the present invention provides a process for making a stiffened and rigid paper which comprises: preparing a pulp slurry consisting is essentially of water, a cellulosic pulp, a crosslinker, and a starch, and optionally a binder; draining the liquid from the pulp slurry to form a web; and drying the web. The crosslinker may be, for example, a glyoxal-containing crosslinker, a gluteraldehyde, a polyfunctional aziridine, a zirconium-containing crosslinker, a titanium-containing crosslinker, and an epichlorohydrin, and mixtures thereof. When a binder is included, the binder may be, for example, a starch, casein, protein binder, carboxymethyl cellulose (CMC), polyvinyl alcohol (PVOH), Gum product, and gelatin, and mixtures thereof.

In another embodiment of the present invention, a process for making a stiffened and rigid paper consists essentially of: preparing a pulp slurry consisting essentially of water, a cellulosic pulp and a starch; draining the liquid from the pulp slurry to form a web; adding at least one crosslinker; and drying the web to produce a paper product. The crosslinker can be added at various stages in the papermaking process. For example, the crosslinker could be added to the wet end of the paper process by spraying onto the web, by adding the crosslinker to the pulp in the furnish, by adding the crosslinker at the sizepress, or adding some of the crosslinker at multiple places to get the desired properties.

The crosslinker is added in an amount effective to provide an unlaminated sheet of paper having a comparable stiffness within 10% of, and a rigidity at least equal to, an equal caliper laminated sheet for a basis weight in the range of 60 lbs/3300 ft^2 to 400 lbs/3300 ft^2. In other words, the present invention provides methods for making an unlaminated paper product of a particular basis weight, wherein the unlaminated paper product has comparable stiffness and equal or greater rigidity to an equal caliper (i.e., equal thickness) laminated paper product made of two or more lower basis weight papers laminated together by any lamination method, such as dry lamination. Accordingly, the present invention provides methods for making a paper product having the improved mechanical properties of a laminated product in the Z-direction, without a lamination step.

DETAILED DESCRIPTION OF THE INVENTION

The present invention provides a process for making a stiffened and rigid paper. The processes of this invention utilize crosslinkers as a main component, to produce paper products having rigidness and stiffness comparable to a laminated sheet. Embodiments of the present invention also provide methods to produce a paper with similar mechanical strength characteristics of a laminated product of equal caliper, but can utilize and produce paper in a higher basis weight range than that which is used and/or produced by known lamination processes. Processes which employ a lamination step are often restricted to using lower basis weight paper because the lamination layer(s) contribute to the total finish caliper of the paper, an important consumer characteristic. The present invention provides a process for making paper with increased stiffness and rigidity, without a lamination process, and can utilize and produce paper in a higher basis weight range since there is no substantial addition to the total finish caliper of the product by the present process.

An embodiment of the present invention provides a process for making a stiffened and rigid paper, the process comprising the steps of: (i) preparing a pulp slurry consisting essentially of water, a cellulosic pulp, a crosslinker, and a starch; (ii) draining the liquid from the pulp slurry to form a web; and (iii) drying the web. The crosslinker can be added by any method known to one skilled in the art such as, for example, spraying it onto the web or adding it as a solution to the pulp slurry. The crosslinker can be added at various stages in the papermaking process as well, either in dry or wet form. For example, the crosslinker could be added to the wet end of the paper process by spraying onto the web, by adding the crosslinker to the pulp in the furnish, by adding the crosslinker at the sizepress, or adding some of the crosslinker at multiple places to get the desired properties. Thus, an alternative embodiment of the present invention is a process for making a stiffened and rigid paper consisting essentially of the steps of: (i) preparing a pulp slurry consisting essentially of water, a cellulosic pulp, and a starch; (ii) draining the liquid from the pulp slurry to form a web; (iii) adding at least one crosslinker; and (iv) drying the web.

The individual process steps of the present invention may be carried out in any known manner using any suitable or conventional paper making machine. For example, a Fourdrinier machine may be used to carry out some or all of the steps of the present invention. In addition, any suitable cellulosic pulp and starch may be used in the present invention. The pulp is the basic paper-making raw material and may be, for example, kraft pulp, sulfite pulps, mechanical pulps, eucalyptus pulp or a is myriad of recycled pulps, among others. The starch is used to increase the stiffness and rigidness of the paper, as well as increase the Scott internal bond. The starch may be, for example, an ethylated starch, oxidized starch, waxy maize, or pearl starch, among others.

The addition of the crosslinker at individual stages may be determined by whether the crosslinker selected is cationic or not. For example, the crosslinker is preferably sprayed onto the web if it is not cationic and is preferably added to the pulp in the furnish if it is cationic. When the crosslinker is applied by spray, the crosslinker is between about 0.3 weight percent and about 20 weight percent, and preferably between about 1.5 weight percent and about 10 weight percent, based on the weight of the total solids. When the crosslinker is present in the pulp slurry, the crosslinker is between about 0.3 weight percent and about 10 weight percent, and preferably between about 0.5 weight percent and about 5 weight percent, based on the weight of the solids in the pulp slurry. The weight percent determination depends, in part, on the nature of the crosslinker and the properties (e.g., rigidness and stiffness) to be achieved and can readily be empirically made.

In addition, different types of crosslinkers can be utilized and added at various stages in the process. For example, one type of crosslinker could be added at the wet end and another type at the sizepress to achieve the desired properties. Effective crosslinkers may include a glyoxal-containing crosslinker, a gluteraldehyde, a polyfunctional aziridine, a zirconium-containing crosslinker, a titanium-containing crosslinker, and an epichlorohydrin, and mixtures thereof. The crosslinker functions to bind the pulp materials together, including at least a portion of the fibers, to greatly increase the sheet stiffness and rigidness and produce a product with mechanical properties comparable to a laminated sheet. Depending on the stage at which the crosslinker is added, the crosslinking may be cured by various downstream stages. For example, the crosslinking may be fully cured by the heat of the rolls in the dry end of the papermaking process. Similarly, the crosslinking may be cured in the heat cycle at the coater, if the sheet is to be coated for the final product.

The process of the present invention may further comprise the step of adding a binder to either the pulp slurry of the water, the cellulosic pulp, the crosslinker, and the starch. Binders can be added to obtain the desired finished is properties or help balance the level of rigidness with the needed stiffness level for paper produced by this invention. For example, starches, casein, or other protein binders can be used if more rigidness is needed with the stiffness. Protein binders can affect the mechanical properties of the product, such as, for example, causing the sheet to become more brittle or rigid. The brittleness and stiffness can be adjusted to achieve the desired mechanical properties of the final paper product. For example, other polymers may be added to the process if more flexibility is needed to balance brittleness while obtaining or maintaining a desired stiffness. Such polymers may include, for example, carboxymethyl cellulose (CMC), polyvinyl alcohol (PVOH), various Gum products, and gelatins (either anionic and/or cationic). As is known to one having ordinary skill in the art, the viscosity of such polymers may vary depending on the desired characteristics of the final product. Depending on the binder employed, the binder may be between about 0.1 weight percent and about 5 weight percent, and preferably between about 1 weight percent and about 2.5 weight percent, based on the weight of the total solids. It is to be understood that the material components of the present invention may be added in any form known in the art. The components may be added as, for example, part of an aqueous solution or as a dry powder.

When a Fourdrinier machine is employed for the papermaking process, the material components of the present invention can be added to the process at the wet end of the process. Specifically, the material components may be added to the process at, for example, the head box, immediately after the slice, onto the web, at the couch roll, or at the sizepress. The components can be added by a variety of methods known in the art such as, for example, by spraying or adding as a solution or slurry. The components may be added together or separately, and the components may be added at separate stages in the process. The components themselves and the location, quantity, method, and order of their addition may be determined based on the properties desired in the final paper product. As illustrated by the Examples below, the following trends, for example, can be inferred: (1) improved stiffness and rigidness can be seen as inversely related to decreased tensile, tear, and fold properties; (2) the greatest improvement to stiffness and rigidity can be attributed to the addition of a crosslinker and higher amounts of crosslinker produced greater results; (3) the addition of further polymers and additives, such as polyvinyl alcohol and carboxymethyl cellulose, may be employed to balance the desired flexibility, rigidness, and stiffness of the final paper product; (4) the crosslinker may be added at various stages in the process such as, for example, at the sizepress and/or the wet end, to produce a paper product with improved stiffness and rigidity; and (5) the present invention can utilize and produce paper in a higher basis weight range since there is no substantial addition to the total finish caliper of the product.

Paper produced by the processes of the present invention has various mechanical properties. The present invention provides a process to produce a paper product having increased stiffness and rigidness. These mechanical properties of the paper product, as well as others, are analyzed using a variety of tests known in the art. Many of these tests are established, collected, and unified by TAPPI, the leading association for the worldwide pulp, paper, packaging, and converting industries. Two commonly known methods for evaluating the bending resistance or stiffness of paper products are described by TAPPI Method T 489, which utilizes a Taber-type tester in its basic configuration, and by TAPPI Method T 543, which utilizes a Gurley-type tester.

Both commonly known methods for measuring stiffness utilize a balanced pendulum or pointer which is center-pivoted and can be weighted at three points below its center. The pointer moves freely in both left and right directions on cylindrical jewel bearings which make the mechanism highly sensitive, even to light-weighted materials. A sample specimen of a specific size is mounted on the Stiffness Tester using a specimen clamp. Located on the pendulum, the lower faces of the specimen clamp jaws are exactly on the center of rotation. This ensures a constant test length and deflection angle for accurate and repeatable results. Both jaws of the specimen clamp are adjustable, so the test specimen can be positioned precisely in the center regardless of material thickness. The clamp is located on one of several positions on a motorized arm which also moves left and right. The bottom 0.25" of the sample overlaps the top of the pointer (a triangular shaped "vane"). During the test, the sample is moved against the top edge of the vane, moving the pendulum until the sample bends and releases it. In a Taber apparatus, force is applied to the lower end of the specimen by a pair of rollers. The rollers, which are attached to a driving disc located directly behind the pendulum, push against the test specimen and deflect it from its vertical position. The pendulum applies increasing torque to the specimen as it deflects further from its original position.

The Gurley unit is a measure of the stiffness of a material. As described is above, the measurement device holds a piece of material vertically and tests the force required to deflect the material a specified amount. One Gurley unit is equivalent to one milligram of force (mgf). A related unit, the Taber, is highly correlated but uses a different apparatus (manufactured by Taber Industries) for performing measurements. The Taber apparatus shows results in Taber units, with each Taber unit equivalent to one gram-centimeter (g-cm). Because the Taber and Gurley apparatuses vary in their methods and analysis units, a conversion equation has been identified which correlates one Taber unit equal to 0.01419 Gurley units, minus 0.935 (T=0.01419 G−0.935). Accordingly, 20-150 g-cm units on the Taber correspond to roughly 2,000-10,000 mgf Gurley stiffness units.

Tests which measure the tensile properties are also utilized in evaluating paper products. The tensile properties of paper are closely linked to the randomly deposited fiber network. A number of parameters, which incorporate such factors as the basis weight of the sheet, the coarseness of the fibers (mass per unit length), and width of the fibers, can be derived to describe the random network formed by the fibers. Other factors will influence the tensile characteristics of the sheet, including the strength of the individual fibers and the strength of the bonds. Two commonly used tests which utilize these factors to measure tensile properties of paper products are Tensile Energy Absorption (TEA) and Scott-type Internal Bond Strength (SIB). A TEA test, in accordance with TAPPI Method T 404 (using a pendulum-type tester) or T 494 (using a constant rate elongation apparatus), measures in pounds per square feet (lb/ft^2) the amount of energy required to fracture a specimen. It is normalized to the surface area of the specimen tested. A higher TEA equates to a tougher paper sheet. Other known methods for performing a TEA test are as taught by the ASTM D828, ISO 1924, and SCAN P38 standards. The TEA test is often used to measure and describe the properties of the paper in the machine direction (MD). The SIB test, in accordance with TAPPI Method T 569, measures the energy absorption and peeling strength of the paper product specimens, sized as card boards, as they are impacted by a specified load at a certain angle. The "Z" directional rupture is initiated by the impact of a pendulum having both a controlled mass and a controlled velocity that exceeds 6000 times the velocity of tensile strength and other dead-weight testers. The geometry of the apparatus causes the tensile stress to be rotational in nature with negligible shear stress on the specimen. Because energy is absorbed during the is elongation and stretching of the sample's fiber network prior to rupture, this internal bond test responds to the semi-elastic nature of paper and paperboard. The test is a measurement of strain energy per unit sample area, which is proportional to the area under the stress-strain curve. The SIB test is often used to measure and describe the properties of the paper in the cross direction (CD).

The Mullen burst strength test is another technique for evaluating the tensile properties of paper, specifically those properties associated with the tear resistance strength of the paper. It is also well known to be an indication of the puncture resistance of the paper sheet. The burst test, according to TAPPI T 403, involves clamping a paper sheet with an annular clamp and then pressurizing a rubber diaphragm behind the paper until it ruptures. Since the sheet may emit an audible "pop," the test is also commonly referred to as the "pop test." A uniform strain is applied to the paper sheet in both the machine and cross machine directions. Therefore, the direction with the lower breaking strain will fail first. This direction is typically the machine direction.

In addition to the above test methods which analyze the tensile properties and the flexural stiffness of paper products, other tests may be used to measure the edgewise compression strength of the paper. One of the primary uses for paper is as packaging material. Paper boxes are often loaded edgewise especially when being stacked. Therefore, it is important to evaluate and control the edgewise compression characteristics of paper. Out-of-plane buckling of the paper sheet, under a given stress, helps to identify the edgewise failure threshold of the paper product. This is particularly true for longer spans of paper than for shorter spans, because longer spans will exhibit a lower compressive strength than short spans. Also, because out-of-plane buckling occurs during edgewise loading, the bending stiffness and long span compression are closely related. The span length can be better defined by a slenderness ratio, which is a ratio of the span length to sample thickness. The various test methods that are available use different slenderness ratios. Therefore, it is important to be aware of the test method used to determine the edgewise compressive strength and its relationship to the particular application. Two commonly used methods known in the art for edgewise compression testing include Ring Crush Testing (RCT) and STFI Short-span compression testing (STFI). Analysis by RCT, according to TAPPI T 818 and T 822, involves a process in which a short cylinder of material is inserted into an annular groove and axially loaded to failure. Results from the RCT analysis are quoted in units of force, such as kN/m. STFI testing measures the compression strength of paper and board materials over a very short compression span. The clamping arrangement for STFI, according to TAPPI T 826, is designed to prevent the test piece from buckling during the test.

The double-fold folding endurance (i.e., M.I.T. folding endurance) of paper products is also often tested, as is known in the art. Folding endurance is the capability of the paper product to withstand multiple folds before it breaks. It is defined as the number of double folds that a strip of 15 mm wide and 100 mm length can withstand, under a specified load, before it breaks. The M.I.T. tester for folding endurance, according to TAPPI T 511, is well known in the art. Folding endurance has been useful in measuring the deterioration of paper upon aging. It is important for printing grades where the paper is subjected to multiple folds like in books, maps, or pamphlets. Long and flexible fibers are believed to provide high folding endurance. Rigid sheets have low M.I.T. folding endurance measurements as these type of sheets have very little stretch in the sheet.

A key concept of the embodiments of the present invention is that they produce a more rigid and stiff paper product than prior art processes, without the need for a lamination layer.

This characteristic is shown by the results of, for example, the Gurley stiffness test, the M.I.T. folding endurance, the Ring Crush Test, and/or the STFI short span compression test. Thus, in an embodiment of the invention, the crosslinker is added in an amount effective to provide an unlaminated sheet of paper having a comparable stiffness within 10% of, and a rigidity at least equal to, an equal caliper laminated sheet. In other words, the present invention provides methods for making an unlaminated paper product of a particular basis weight, wherein the unlaminated paper product has comparable stiffness and equal or greater rigidity to an equal caliper (i.e., equal thickness) laminated paper product made of two or more lower basis weight papers laminated together by any lamination method, such as dry lamination. More generally, the present invention is directed to producing paper for applications requiring increased rigidness and stiffness, such as cards, playing cards, or boxes, among others, and preferably has a basis weight of at least about 60 lbs/3300 ft^2 to about 400 lbs/3300 ft^2.

In achieving the production of a more rigid paper product, without the use of a lamination process, other mechanical properties of the paper may be maintained or reduced, as is known to one skilled in the art. For example, the mechanical strength properties of tensile, stretch, tear, and fold may decrease as they are often properties that are contrary to the indication of a more rigid sheet. An increase in rigidness can be seen as an increase in the brittleness of the sheet, which can be identified by a decrease in the M.I.T. double-fold folding endurance test results. The results of the Tensile Energy Absorption (TEA) and Scott-type Internal Bond (SIB) tests may similarly be evaluated to indicate that a more rigid sheet was produced. Maintained or decreased results for these tests may inversely relate to improved rigidity of the paper product, as shown by more direct stiffness tests.

As mentioned above, an embodiment of the present invention is a process comprising the steps of: (i) preparing a pulp slurry consisting essentially of water, a cellulosic pulp, a crosslinker, and a starch, and optionally a binder, wherein when a binder is employed the binder is added to the slurry separately from the crosslinker; (ii) draining the liquid from the pulp slurry to form a web; and (iii) drying the web. A pulp slurry which consists essentially of water, a cellulosic pulp, a crosslinker, and a starch, and optionally a binder excludes other constituents from the slurry that would affect the basic and novel characteristics of the invention, including those described herein, such as the increased rigidness and stiffness. Such constituents include a polyvinyl alcohol/vinylamine copolymer. This concept applies similarly to the embodiment of the present invention which is a process for making a stiffened and rigid paper consisting essentially of the steps of: (i) preparing a pulp slurry consisting essentially of water, a cellulosic pulp, and a starch; (ii) draining the liquid from the pulp slurry to form a web; (iii) adding at least one crosslinker; and (iv) drying the web. In particular, in this embodiment, no other constituents are added to the pulp slurry or otherwise to the web throughout the paper making process that would affect the basic and novel characteristics of the invention, including those described herein, such as the increased rigidness and stiffness.

Embodiments of the present invention provide a process for making a paper with increased stiffness and rigidity, as shown in the following examples. The processes of this invention utilize crosslinkers as a main component, to produce paper products having increased rigidness and stiffness comparable to a laminated sheet. As rigidness and stiffness have been identified as important characteristics for particular products, the embodiments of the present invention provide methods to produce paper products in which these characteristics are enhanced while other characteristics may be maintained or reduced. The examples below show various embodiments of the present invention which produce paper products with similar mechanical strength characteristics of a laminated product of equal caliper, but which can utilize and produce paper in a higher basis weight range than that which is used and/or produced by known lamination processes. The processes of the present invention were tested to produce paper products having three target freeness levels: 200, 350, and 500 ml C.S.F. Freeness, measured in units of Canadian Standard Freeness (C.S.F.), is a term used to define how quickly water is drained from the pulp. The opposite of freeness is slowness. Freeness or slowness is the function of beating or refining, as is known in the art. Additionally, the processes of the present invention were tested to produce paper products having three target basis weights: 65 lbs/3000 ft^2, 115 lbs/3000 ft^2, and 165 lbs/3000 ft^2.

EXAMPLES

The following examples are included to more clearly demonstrate the overall nature of the present invention. Examples 1, 2, and 3 illustrate the improved results obtained by employing the papermaking processes of this invention. The Examples illustrate the products which may be obtained, and the properties which may be achieved, according to the embodiments of the present invention. The Examples below describe processes in which various components are added at various stages of the papermaking process, in accordance with the embodiments of the present invention. In addition to a base pulp slurry, the examples describe sample formulations which include a starch. For example, a hydroxyethyl starch sold by Penford Products Co. under the trade name "PENFORD GUM 280" or "PENFORD GUM 290" was employed in the sample formulations. A crosslinker, such as a Glyoxal-containing crosslinker sold by BASF under the trade name "CURESAN" and/or a polyamide-epichlorohydrin crosslinker sold by Ashland Hercules under the trade name "POLYCUP 172," is employed in a number of sample formulations. Additionally, in accordance with various embodiments of the present invention, various sample formulations include a polyvinyl alcohol, such as that sold by Celanese Corporation under the trade name "CELVOL," and/or a carboxymethylcellulose (CMC), such as that sold by Ashland Hercules under the trade name "CMC 7MCT."

Example 1

A first sample set was tested with a target refining freeness of 200 ml C.S.F. and a target basis weight of 65 lbs/3000 ft^2. The following sample processes were tested:

A1: A control paper product manufactured by adding only 60 lbs of PENFORD GUM 290 hydroxyethyl starch per ton of dry paper pulp at the size press.

A2: A paper product manufactured by adding 60 lbs of PENFORD GUM 290 hydroxyethyl starch per ton of dry paper pulp at the sizepress and 6 lbs POLYCUP 172 polyamide-epichlorohydrin crosslinker at the couch roll.

A3: A paper product manufactured by adding 60 lbs of PENFORD GUM 290 hydroxyethyl starch per ton of dry paper pulp at the sizepress and 6 lbs of CURESAN 200 Glyoxal-containing crosslinker per ton of dry paper pulp at the couch roll.

A4: A paper product manufactured by adding 60 lbs of PENFORD GUM 290 hydroxyethyl starch per ton of dry paper pulp at the couch roll and 60 lbs of CURESAN 200 Glyoxal-containing crosslinker per ton of dry paper pulp at the size press.

A5: A paper product manufactured by adding 50 lbs of CELVOL 165S polyvinyl alcohol per ton of dry paper pulp to the pulp slurry, 60 lbs of PENFORD GUM 290 hydroxyethyl starch per ton of dry paper pulp at the sizepress, and 60 lbs of CURESAN 200 Glyoxal-containing crosslinker per ton of dry paper pulp at the size press.

A6: A paper product manufactured by adding 50 lbs of CELVOL 165S polyvinyl alcohol per ton of dry paper pulp to the pulp slurry, and 60 lbs of PENFORD GUM 290 hydroxyethyl starch per ton of dry paper pulp at the sizepress and 200 lbs of CURESAN 200 Glyoxal-containing crosslinker per ton of dry paper pulp at the couch roll.

A7: A paper product manufactured by adding 60 lbs of CURESAN 200 Glyoxal-containing crosslinker per ton of dry paper pulp at the couch roll and 30 lbs of CELVOL 165S per ton of dry paper pulp at the size press.

The sample paper products manufactured according to the processes described above were then analyzed using the tests described above, in accordance with their respective TAPPI standards. Table 1 below shows the results of these tests:

TABLE 1

Paper products produced according to embodiments of the present invention, with a target refining freeness of 200 ml C.S.F. and a target basis weight of 65 lbs/3000 ft^2.

| | MD DRY TEA | CD DRY Stretch | M.I.T. FOLD | STFI | | Ring Crush | | Dry Tensile | Gurley |
|---|---|---|---|---|---|---|---|---|---|
| Sample | in lb/sq ft Mean | Ft/lbs/sq in Mean | no. dbl fold Mean | Normalized Geo. Mean | Normalized Density | Normalized Geo. Mean | Normalized Density | Normalized Geo. Mean | Stiffness Normalized |
| A1 | 172.79 | 6.89 | 100.80 | 10.81 | 9.61 | 40.192 | 35.753 | 32.75 | 329.405 |
| A2 | 168.38 | 7.30 | 92.40 | 11.01 | 10.64 | 43.657 | 42.167 | 32.64 | 365.499 |
| A3 | 153.76 | 7.22 | 95.20 | 11.13 | 10.78 | 44.038 | 42.672 | 33.03 | 361.586 |
| A4 | 129.81 | 5.18 | 6.30 | 12.74 | 11.49 | 49.339 | 44.498 | 32.68 | 369.775 |
| A5 | 139.03 | 5.34 | 7.70 | 12.81 | 11.66 | 50.812 | 46.225 | 33.66 | 381.039 |
| A6 | 120.39 | 4.40 | 1.00 | 12.48 | 12.34 | 49.331 | 48.799 | 31.37 | 406.489 |
| A7 | 166.22 | 7.22 | 67.40 | 11.75 | 10.47 | 42.512 | 37.863 | 34.22 | 331.422 |

Table 1 shows the results of the test samples which target a refining freeness of 200 ml C.S.F. and a basis weight of 65 lbs/3000 ft^2. All of the tests samples in this sample set showed an improved stiffness and rigidity over the control A1 sample, which was a control paper product manufactured by adding only 60 lbs of PENFORD GUM 290 hydroxyethyl starch per ton of dry paper pulp to the fiber pulp web at the sizepress. While sample paper products A2-A7 all showed improved stiffness and rigidity measurements, the test product manufactured according to the A6 process showed the best results at this refining freeness and basis weight. The A6 process manufactured a paper product by adding 50 lbs of CELVOL 165S polyvinyl alcohol per ton of dry paper pulp to the pulp slurry, and 60 lbs of PENFORD GUM 290 hydroxyethyl starch per ton of dry paper pulp at the sizepress and 200 lbs of CURESAN 200 Glyoxal-containing crosslinker per ton of dry paper pulp at the couch roll. This sample product presented the best combination of performance metrics from the Ring Crush Test, STFI is test, and Gurley Stiffness test, as can be seen in Table 1 above. As described above, the improved stiffness and rigidness can be seen as inversely related to decreased tensile, tear, and fold properties shown by the TEA, SIB, and M.I.T. tests in Table 1.

When the crosslinker is alternatively added at the sizepress instead of at the couch roll, as it is in the A5 process, the process still produced a paper product with improved stiffness and rigidity when compared to the product of the control A1 process. Additionally, as the A7 process shows, the polyvinyl alcohol may be added at the sizepress instead of to the pulp slurry. The A7 process configuration shows that the stiffness and rigidity may be improved while retaining tensile, stretch, and fold properties comparable to the control A1 process. Accordingly, the components themselves and the location, quantity, method, and order of their addition may be adjusted based on the properties desired in the final paper product.

Example 2

Another sample set was tested with a target refining freeness of 350 ml C.S.F. and a target basis weight of 115 lbs/3000 ft^2. The following sample processes were tested:

B1: A control paper product manufactured by adding only 60 lbs of PENFORD GUM 280 hydroxyethyl starch per ton of dry paper pulp at the sizepress.

B2: A paper product manufactured by adding 30 lbs CELVOL 165S polyvinyl alcohol to the pulp slurry and 60 lbs of PENFORD GUM 280 hydroxyethyl starch per ton of dry paper pulp at the sizepress.

B3: A paper product manufactured by adding 50 lbs of CELVOL 165S polyvinyl alcohol per ton of dry paper pulp to the pulp slurry and 60 lbs of PENFORD GUM 280 hydroxyethyl starch per ton of dry paper pulp at the sizepress.

B4: A control paper product manufactured by adding only 60 lbs of PENFORD GUM 280 hydroxyethyl starch per ton of dry paper pulp at the sizepress.

B5: A paper product manufactured by adding 25 lbs of CMC 7MCT carboxymethylcellulose per ton of dry paper pulp to the pulp slurry and 60 lbs of PENFORD GUM 280 hydroxyethyl starch per ton of dry paper pulp at the sizepress.

is B6: A paper product manufactured by adding 50 lbs of CMC 7MCT carboxymethylcellulose per ton of dry paper pulp to the pulp slurry and 60 lbs of PENFORD GUM 280 hydroxyethyl starch per ton of dry paper pulp at the sizepress.

B7: A control paper product manufactured by adding 200 lbs of water per ton of dry paper pulp at the couch roll and 60 lbs of PENFORD GUM 280 hydroxyethyl starch per ton of dry paper pulp at the sizepress.

B8: A paper product manufactured by adding 200 lbs of CURESAN 200 Glyoxal-containing crosslinker per ton of dry paper pulp at the couch roll and 60 lbs of PENFORD GUM 280 hydroxyethyl starch per ton of dry paper pulp at the sizepress.

B9: A paper product manufactured by adding 25 lbs of CELVOL 165S polyvinyl alcohol per ton of dry paper pulp to the pulp slurry, 200 lbs of CURESAN 200 Glyoxal-containing crosslinker per ton of dry paper pulp at the couch roll, and 60 lbs of PENFORD GUM 280 hydroxyethyl starch per ton of dry paper pulp at the sizepress.

B10: A paper product manufactured by adding 25 lbs of CMC 7MCT carboxymethylcellulose per ton of dry paper pulp to the pulp slurry, 200 lbs of CURESAN 200 Glyoxal-containing crosslinker per ton of dry paper pulp at the couch roll, and 60 lbs of PENFORD GUM 280 hydroxyethyl starch per ton of dry paper pulp at the sizepress.

The sample paper products manufactured according to the processes described in Example 2 were then analyzed using the tests described above, in accordance with their respective TAPPI standards. Table 2 below shows the results of these tests:

TABLE 2

Paper products produced according to embodiments of the present invention, with a target refining freeness of 350 ml C.S.F. and a target basis weight of 115 lbs/3000 ft^2.

| | MD DRY TEA | CD DRY stretch | M.I.T. FOLD | STFI | | Ring Crush | | Dry Tensile | Gurley |
|---|---|---|---|---|---|---|---|---|---|
| Sample | in lb/sq ft Mean | Percent Mean | no. dbl fold Mean | Normalized Geo. Mean | Normalized Density | Normalized Geo. Mean | Normalized Density | Normalized Geo. Mean | Stiffness Normalized |
| B1 | 273.77 | 7.64 | 78.10 | 17.68 | 15.34 | 91.459 | 79.370 | 52.39 | 1609.752 |
| B2 | 268.46 | 7.58 | 80.30 | 18.04 | 15.54 | 92.562 | 79.768 | 53.43 | 1669.286 |
| B3 | 273.23 | 7.33 | 81.70 | 18.10 | 15.67 | 94.260 | 81.583 | 53.97 | 1624.682 |
| B4 | 281.94 | 7.71 | 91.90 | 17.90 | 15.38 | 91.365 | 78.481 | 53.10 | 1566.051 |
| B5 | 352.58 | 7.80 | 96.60 | 19.13 | 16.39 | 99.865 | 85.560 | 59.21 | 1658.038 |
| B6 | 367.46 | 8.13 | 115.80 | 19.24 | 16.25 | 100.448 | 84.850 | 60.80 | 1669.448 |
| B7 | 292.53 | 7.44 | 57.90 | 17.78 | 15.24 | 96.864 | 83.012 | 56.16 | 1638.309 |
| B8 | 159.15 | 4.39 | 0.00 | 21.71 | 19.34 | 123.628 | 110.129 | 53.90 | 1990.019 |
| B9 | 172.77 | 4.10 | 0.00 | 21.69 | 19.19 | 116.647 | 103.208 | 53.59 | 1972.528 |
| B10 | 209.46 | 4.54 | 0.00 | 23.38 | 19.40 | 128.430 | 106.525 | 59.49 | 1902.573 |

Table 2 shows the results of the test samples which target a refining freeness of 350 ml C.S.F. and a basis weight of 115 lbs/3000 ft^2. In addition to showing the effects of the various stages for addition of the components on the resulting paper product properties, these tests further show the impact that polyvinyl alcohol, carboxymethyl cellulose, and the Glyoxal-containing crosslinker individually have on the products. Control processes B1 and B4 manufactured a paper product by adding only 60 lbs of PENFORD GUM 290 hydroxyethyl starch per ton of dry paper pulp to the fiber pulp web at the sizepress. Control process B7 manufactured a paper product by adding 200 lbs of water per ton of dry paper pulp at the couch roll and 60 lbs of PENFORD GUM 280 hydroxyethyl starch per ton of dry paper pulp at the sizepress. Processes B2 and B3 added varying amounts of polyvinyl alcohol to the pulp slurry, and showed improved stiffness and rigidity measurements over the product of process B1. Processes B5 and B6 added varying amounts of carboxymethyl cellulose to the pulp slurry, and also showed improved stiffness and rigidity measurements over the product of process B4. The greatest improvements to the stiffness and rigidity of the paper products, however, were seen in products produced according to processes B8, B9, and B10, all of which contained the crosslinker.

Processes B9 and B10 added polyvinyl alcohol and carboxymethyl cellulose to the crosslinker, respectively. As shown by the results of process B8 in Table 2, however, the greatest improvement to stiffness and rigidity can be attributed to the addition of the crosslinker. As discussed above, the improved stiffness and rigidness can be seen as inversely related to decreased tensile, elongation, and fold properties shown by the TEA, Stretch, and M.I.T. Fold tests in Table 2. The processes of B9 and B10, which add polyvinyl alcohol and carboxymethyl cellulose to the crosslinker, respectively, show favorable rigidity and stiffness results and also retain some of the tensile, stretch, and fold properties in the paper product. Accordingly, while the addition of a crosslinker offers significant gains to the stiffness and rigidity of the paper product, the addition of further polymers and additives may be employed to balance the desired flexibility, rigidness, and stiffness of the final paper product.

Example 3

A further sample set was tested with a target refining freeness of 500 ml C.S.F. Two target basis weights were tested for this sample set: a first subset including samples C1-C6 with the target basis weight of 165 lbs/3000 ft^2 and a second subset including samples C7-C9 with the target basis weight of 65 lbs/3000 ft^2. The following sample processes were tested:

C1: A control paper product manufactured by adding only 60 lbs of PENFORD GUM 280 hydroxyethyl starch per ton of dry paper pulp at the sizepress.

C2: A paper product manufactured by adding 60 lbs of PENFORD GUM 280 hydroxyethyl starch per ton of dry paper pulp at the sizepress and 6 lbs of CURESAN 200 Glyoxal-containing crosslinker per ton of dry paper pulp at the couch roll.

C3: A paper product manufactured by adding 60 lbs of PENFORD GUM 280 hydroxyethyl starch per ton of dry paper pulp at the sizepress and 200 lbs of CURESAN 200 Glyoxal-containing crosslinker per ton of dry paper pulp at the couch roll.

C4: A paper product manufactured by adding 50 lbs of CELVOL 165S polyvinyl alcohol per ton of dry paper pulp to the pulp slurry, 200 lbs of CURESAN 200 Glyoxal-containing crosslinker per ton of dry paper pulp at the couch roll, and 60 lbs of PENFORD GUM 280 hydroxyethyl starch per ton of dry paper pulp at the sizepress.

C5: A paper product manufactured by adding 50 lbs of CELVOL 165S polyvinyl alcohol per ton of dry paper pulp to the pulp slurry, and 6 lbs of CURESAN 200 Glyoxal-containing crosslinker per ton of dry paper pulp at the couch roll and 60 lbs of PENFORD GUM 280 hydroxyethyl starch per ton of dry paper pulp at the sizepress.

C6: A paper product manufactured by adding 50 lbs of CELVOL 165S polyvinyl alcohol per ton of dry paper pulp to the pulp slurry, 6 lbs of POLYCUP 172 polyamide-epichlorohydrin crosslinker per ton of dry paper pulp at the couch roll, and 60 lbs of PENFORD GUM 280 hydroxyethyl starch per ton of dry paper pulp at the sizepress.

C7: A paper product with the target basis weight of 65 lbs/3000 ft^2 manufactured by adding 60 lbs of PENFORD GUM 280 hydroxyethyl starch per ton of dry paper pulp at the sizepress and 6 lbs of CURESAN 200 Glyoxal-containing crosslinker per ton of dry paper pulp at the couch roll.

C8: A paper product with the target basis weight of 65 lbs/3000 ft^2 manufactured by adding 50 lbs of CELVOL 165S polyvinyl alcohol per ton of dry paper pulp to the pulp slurry, and 6 lbs of CURESAN 200 Glyoxal-containing crosslinker per ton of dry paper pulp at the couch roll and 60 lbs of PENFORD GUM 280 hydroxyethyl starch per ton of dry paper pulp at the sizepress.

C9: A paper product with the target basis weight of 65 lbs/3000 ft^2 manufactured by adding 50 lbs of CELVOL 165S polyvinyl alcohol per ton of dry paper pulp to the pulp slurry, 6 lbs of POLYCUP 172 polyamide-epichlorohydrin crosslinker per ton of dry paper pulp at the couch roll, and 60 lbs of PENFORD GUM 280 hydroxyethyl starch per ton of dry paper pulp at the sizepress.

The sample paper products manufactured according to the processes described in Example 3 were then analyzed using the tests described above, in accordance with their respective TAPPI standards. Table 3 below shows the results of these tests:

TABLE 3

Paper products produced according to embodiments of the present invention, with a target refining freeness of 500 ml C.S.F.

| | MD DRY TEA | CD DRY stretch | M.I.T. FOLD | STFI | | Ring Crush | | Dry Tensile | Gurley |
|---|---|---|---|---|---|---|---|---|---|
| Sample | in lb/sqft Mean | Percent Mean | no. dbl fold Mean | Normalized Geo. Mean | Normalized Density | Normalized Geo. Mean | Normalized Density | Normalized Geo. Mean | Stiffness Normalized |
| C1 | 130.33 | 4.32 | 30.00 | 17.13 | 16.79 | 93.294 | 91.422 | 48.98 | 4253.601 |
| C2 | 150.39 | 4.87 | 43.44 | 18.23 | 17.38 | 103.477 | 98.615 | 54.18 | 4422.724 |
| C3 | 93.05 | 2.70 | 1.00 | 20.04 | 19.30 | 110.252 | 106.217 | 52.97 | 4747.070 |
| C4 | 131.02 | 3.37 | 0.80 | 23.11 | 22.07 | 128.978 | 123.226 | 61.63 | 4633.489 |
| C5 | 161.57 | 4.81 | 38.10 | 20.05 | 18.27 | 113.117 | 103.068 | 58.87 | 4269.304 |
| C6 | 166.15 | 5.16 | 42.80 | 19.31 | 18.25 | 108.862 | 102.889 | 57.36 | 4434.834 |
| C7 | 51.61 | 3.39 | 22.90 | 7.16 | 7.56 | 32.373 | 34.144 | 20.68 | 388.444 |
| C8 | 55.44 | 3.49 | 31.70 | 7.65 | 8.18 | 33.832 | 36.209 | 22.20 | 395.993 |
| C9 | 53.83 | 2.65 | 3.30 | 8.85 | 9.21 | 70.926 | 41.812 | 24.22 | 408.804 |

Samples C1-C6 have a target basis weight of 165 lbs/3000 ft^2 and samples C7-C9 have a the target basis weight of 65 lbs/3000 ft^2.

Table 3 shows the results of the test samples which target a refining freeness of 500 ml C.S.F. Two sample subsets were produced, the first with a target basis weight of 165 lbs/3000 ft^2 and a second with a target basis weight of 65 lbs/3000 ft^2. As with the earlier examples, the samples produced in Example 3 also showed an improvement in stiffness and rigidity when a crosslinker is employed in the papermaking process. For paper products having a target basis weight of 165 lbs/3000 ft^2, characterized in the art as high basis weight paper, the addition of a crosslinker produced a paper product having improved stiffness and rigidity measurements in comparison to the control samples. Process C3, which added 60 lbs of PENFORD GUM 280 hydroxyethyl starch per ton of dry paper pulp at the sizepress and 200 lbs of CURESAN 200 Glyoxal-containing crosslinker per ton of dry paper pulp at the couch roll, showed the most improvement in stiffness and rigidity according to the Gurley Stiffness, Ring Crush, and STFI short span compression tests, as can be is seen in Table 3.

The further addition of a polyvinyl alcohol in process C4 showed similar improvements in stiffness and rigidity, while retaining some of the tensile and stretch properties of the control C1 process. Additionally, higher amounts of crosslinker were found to produce greater improvements in the stiffness and rigidity measurements, as can be seen when comparing the results of process C2 and C3. Similar analysis is possible from the results of the target refining freeness of 500 ml C.S.F. with a target basis weight of 65 lbs/3000 ft^2. For example, the results for processes C7, C8, and C9 show that higher amounts of the crosslinker result in more improved stiffness and rigidity measurements. These results also show that polyvinyl alcohol may be optionally added to the process to retain stretch, tensile, and fold properties of the paper product.

For the tests described in Examples 1, 2, and 3, a spray nozzle was used with the material diluted down to 3% solids by weight to get an even spray across the web. The result was a fairly even spray across the web. The paper machine employed for these tests produced a 12 wide sheet. When polyvinyl alcohol was used, it was added to the wet end at the line leading up to the headbox at about 5% solids by weight. The polyvinyl alcohol was added as an uncooked component in the swelled state, and was cooked in the dryer section of the papermaking process.

It was noticed during the tests that, when the Glyoxal-containing crosslinker was sprayed onto the wire web at the wet end of the process, the Glyoxal-containing crosslinker caused a much higher caliper than as expected. Without being held to the theory, it is believed that this occurred because the Glyoxal-containing crosslinker was acting as a bulking agent. To adjust for this effect, some fiber was removed from the sheet. Even with a lower fiber quantity, the test results showed an increase in stiffness when a crosslinker was added to the process over the control samples. Tests like, for example, M.I.T. Fold, Ring Crush test, and STFI short span compression test, relate to the rigidity of the paper product. As Tables 1, 2, and 3 show for the different target basis weight and refining freeness samples, the samples which include a crosslinker showed an increase in stiffness measurements when compared to the control samples at the same basis weight and freeness.

The results of the tests were more pronounced in the paper products having lower target refining freeness. Without being held to the theory, these lower measurements might be showing the result of a more open sheet and thus poor retention of the material components when being sprayed on the sheet, or otherwise added to the process. These results may be further adjusted, and paper products having improved rigidity and stiffness at any refining freeness and basis weight may be produced, by changing how or where the crosslinker is added. For example, the desired properties may be better achieved if the same crosslinker, or different crosslinkers, are added to the process at multiple stages, in accordance with an embodiment of the present invention. For example, one or more crosslinkers may be added at the sizepress and/or at the wet end of the papermaking process.

The examples of the present invention show that, while polymer type materials may affect stiffness and rigidity, the addition of a crosslinker greatly increases these properties. The crosslinker may be added at various stages in the process such as, for example, at the sizepress and/or the wet end, to produce a paper product with improved stiffness and rigidity. The embodiments of the present invention provide a process for making paper with increased stiffness and rigidity, without a lamination process, and can utilize and produce paper in a higher basis weight range since there is no substantial addition to the total finish caliper of the product by the present process.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A process for making a stiffened and rigid paper, the process consisting essentially of:

(i) preparing a pulp slurry consisting essentially of water, a cellulosic pulp, and a starch, and optionally a binder;

(ii) draining the liquid from the pulp slurry to form a web;

(iii) adding at least one crosslinker in an amount of from about 0.3 weight percent to about 10 weight percent based on a weight of total solids of the pulp slurry; and (iv) drying the web to produce a paper product having a basis weight of about 60 lbs./3300 $ft^2$ to about 400 lbs./3300 $ft^2$.

2. The process of claim 1, wherein the at least one crosslinker is added by spraying the crosslinker onto the web.

3. The process of claim 1, wherein the at least one crosslinker is added at a sizepress.

4. The process of claim 1, wherein the at least one crosslinker is added by spraying the crosslinker onto the web and added at a sizepress.

5. The process of claim 1, wherein the at least one crosslinker is selected from the group consisting of a glyoxal-containing crosslinker, a gluteraldehyde, a polyfunctional aziridine, a zirconium-containing crosslinker, a titanium-containing crosslinker, and an epichlorohydrin, and mixtures thereof.

6. The process of claim 1, wherein the at least one crosslinker is a glyoxal-containing crosslinker.

7. The process of claim 1, wherein adding the at least one crosslinker comprises first forming a crosslinker slurry and then adding the crosslinker slurry to the web.

8. The process of claim 1, wherein the pulp slurry includes the binder.

9. The process of claim 8, wherein the binder is polyvinyl alcohol (PVOH).

10. The process of claim 8, wherein the binder is selected from the group consisting of starch, casein, protein binders, carboxymethyl cellulose (CMC), polyvinyl alcohol (PVOH), Gum products, and gelatins, and mixtures thereof.

11. The process of claim 1, wherein the crosslinker is added in an amount effective to provide an unlaminated sheet of paper having a stiffness of within 10% of, and a rigidity at least equal to, an equal caliper laminated sheet for a basis weight in the range of 60 lbs/3300 ft^2 to 400 lbs/3300 ft^2.

12. The process of claim 1, wherein the crosslinker is present in the web in an amount of at least about 1.5 weight percent based on the weight of solids in the web.

13. The process of claim 1, wherein the crosslinker is present in the web in an amount between about 0.5 to about 5 weight percent based on the weight of solids in the web.

14. The process of claim 1, wherein the at least one crosslinker is present at an amount of 60 to 200 lbs, of crosslinker per ton of dry paper pulp.

15. The process of claim 1, wherein the binder is polyvinyl alcohol (PVOH), and the binder is present in an amount between about 0.1 weight percent and about 5 weight percent based on the weight of the total solids.

16. A process for making a stiffened and rigid paper, the process consisting of:

(i) preparing a pulp slurry consisting of water, a cellulosic pulp, a starch, and optionally a binder;

(ii) draining the liquid from the pulp slurry to form a web;

(iii) adding at least one crosslinker; and (iv) drying the web to produce a paper product.

* * * * *